US007543524B1

(12) United States Patent
Javorsky

(10) Patent No.: US 7,543,524 B1
(45) Date of Patent: Jun. 9, 2009

(54) MACHINE GUN MOUNT

(75) Inventor: David M. Javorsky, Dingmans Ferry, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 546 days.

(21) Appl. No.: 11/307,888

(22) Filed: Feb. 27, 2006

Related U.S. Application Data

(60) Provisional application No. 60/593,956, filed on Feb. 28, 2005.

(51) Int. Cl.
*F41A 23/00* (2006.01)

(52) U.S. Cl. ..... 89/37.01; 89/37.03; 89/37.11; 89/37.16; 42/94; 42/98

(58) Field of Classification Search ..... 89/37.01, 89/37.03, 37.11, 37.16, 41.22; 42/94, 98
See application file for complete search history.

(56) References Cited

U.S. PATENT DOCUMENTS 2,415,153 A * 2/1947 Trimbach et al. ..... 89/37.03
6,283,428 B1 * 9/2001 Maples et al. ..... 42/94
6,286,411 B1 * 9/2001 Sanderson ..... 89/37.03
6,393,960 B1 * 5/2002 Bilger ..... 89/37.03
7,258,055 B1 * 8/2007 Javorsky ..... 89/37.01

* cited by examiner

*Primary Examiner*—Troy Chambers
*Assistant Examiner*—Jonathan C Weber
(74) *Attorney, Agent, or Firm*—Michael Sachs

(57) ABSTRACT

A machine gun mount for attachment to a movable support arm of a helicopter and for holding a machine gun, the machine gun mount comprising a pintle that is rotatably connected at a first end to the movable support arm, the first end of the pintle providing for rotation of the machine gun about a vertical axis; a gun cradle that is rotatably connected to a second end of the pintle, the second end of the pintle providing for rotation of the machine gun about a horizontal axis; an ammunition magazine disposed on a first side of the gun cradle; and a spent case catch bag disposed on a second side of the gun cradle.

13 Claims, 10 Drawing Sheets

MACHINE GUN MOUNT

CROSS-REFERENCE TO RELATED APPLICATIONS

This application claims the benefit under 35 USC 119(e) of U.S. provisional patent application No. 60/593,956 filed on Feb. 28, 2005, which application is hereby incorporated by reference. The subject matter of the present application is related to the subject matter of nonprovisional patent application Ser. No. 10/709,044 filed on Apr. 8, 2004, which has the same inventor as the present application and is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to weapons and in particular to a mount for a machine gun that is fired from a helicopter.

Machine guns such as the M240 may be mounted in a helicopter and fired while the helicopter is underway. The machine gun is attached to the helicopter via a machine gun mount. The machine gun mount allows the machine gun to rotate in the horizontal plane (i.e., rotate around a vertical axis) and also the rotate in a vertical plane (i.e., about a horizontal axis). The primary aircraft for mounting the M240 are the UH60 and CH47 helicopters. On the CH47 helicopter, the machine gun may be door, window or ramp mounted.

Existing mounts suffer from a variety of problems. Mobility of the machine gun during firing and stowage may be restricted due to interference with other structures inside the helicopter. The machine gun dust cover (on the cartridge ejection opening) cannot be opened while the machine gun is in the mount. The ammunition magazine, that is part of the machine gun mount, requires two-handed operation to remove from the mount and replace with a full ammunition magazine. The lid of the ammunition magazine is susceptible to accidental opening because the latch may be opened by simply pushing on the top of the latch. The empty cartridge links tend to jam up at the link collector chute. The mounting pins are not captive and, therefore, may be easily lost.

SUMMARY OF THE INVENTION

It is an object of the invention to provide a machine gun mount that increases mobility of the machine gun, compared to known mounts.

Another object of the invention is to provide a machine gun mount that allows the machine gun dust cover on the cartridge ejection opening to be opened while the machine gun is in the mount.

A further object of the invention is to provide a machine gun mount with an ammunition magazine that can be removed and replaced using one hand.

Still another object of the invention is to provide a machine gun mount with an ammunition magazine having a lid that is not susceptible to accidental opening.

Yet another object of the invention is to provide a machine gun mount with a link collector that does not jam.

A still further object of the invention is to provide a machine gun mount with mounting pins that are captive and, therefore, not easily lost.

One aspect of the invention is a machine gun mount for attachment to a movable support arm of a helicopter and for holding a machine gun, the machine gun mount comprising a pintle that is rotatably connected at a first end to the movable support arm, the first end of the pintle providing for rotation of the machine gun about a vertical axis; a gun cradle that is rotatably connected to a second end of the pintle, the second end of the pintle providing for rotation of the machine gun about a horizontal axis; an ammunition magazine disposed on a first side of the gun cradle; and a spent case catch bag disposed on a second side of the gun cradle.

The spent case catch bag frame is attached to the second side of the gun cradle. The spent case catch bag is attached to the spent case catch bag frame. The spent case catch bag frame includes a pair of generally U-shaped supports disposed inside the spent case catch bag at opposite ends thereof. The spent case catch bag frame comprises a link chute on a top surface thereof, the link chute including an opening having a width that is greater than a width of a link ejection opening in the machine gun.

The ammunition magazine comprises a box, a lid and a latch for closing the lid to the box, an upper portion of the latch including a latch cover.

A cradle bracket is attached to the first side of the gun cradle. The cradle bracket includes a pair of vertical slots on opposite sides thereof and a spring latch disposed in an opening in the cradle bracket; a pair of mounting brackets attached to the ammunition magazine and operable to slide in the vertical slots in the cradle bracket; and a stop disposed on the ammunition magazine above the pair of mounting brackets.

In one embodiment, a travel lock is attached to the pintle, the pintle including an opening therethrough that includes a recess for capturing at least one spring loaded ball on the end of a quick release pin.

Another aspect of the invention is an apparatus comprising a machine gun having a link ejection opening, a spent cartridge ejection opening and a dust cover for covering the spent cartridge ejection opening; and a machine gun mount for attachment to a movable support arm of a helicopter and for holding the machine gun, the machine gun mount comprising a pintle that is rotatably connected at a first end to the movable support arm, the first end of the pintle providing for rotation of the machine gun about a vertical axis; a gun cradle that is rotatably connected to a second end of the pintle, the second end of the pintle providing for rotation of the machine gun about a horizontal axis; an ammunition magazine disposed on a first side of the gun cradle; and a spent case catch bag disposed on a second side of the gun cradle.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figures 1, 1A, 1B:
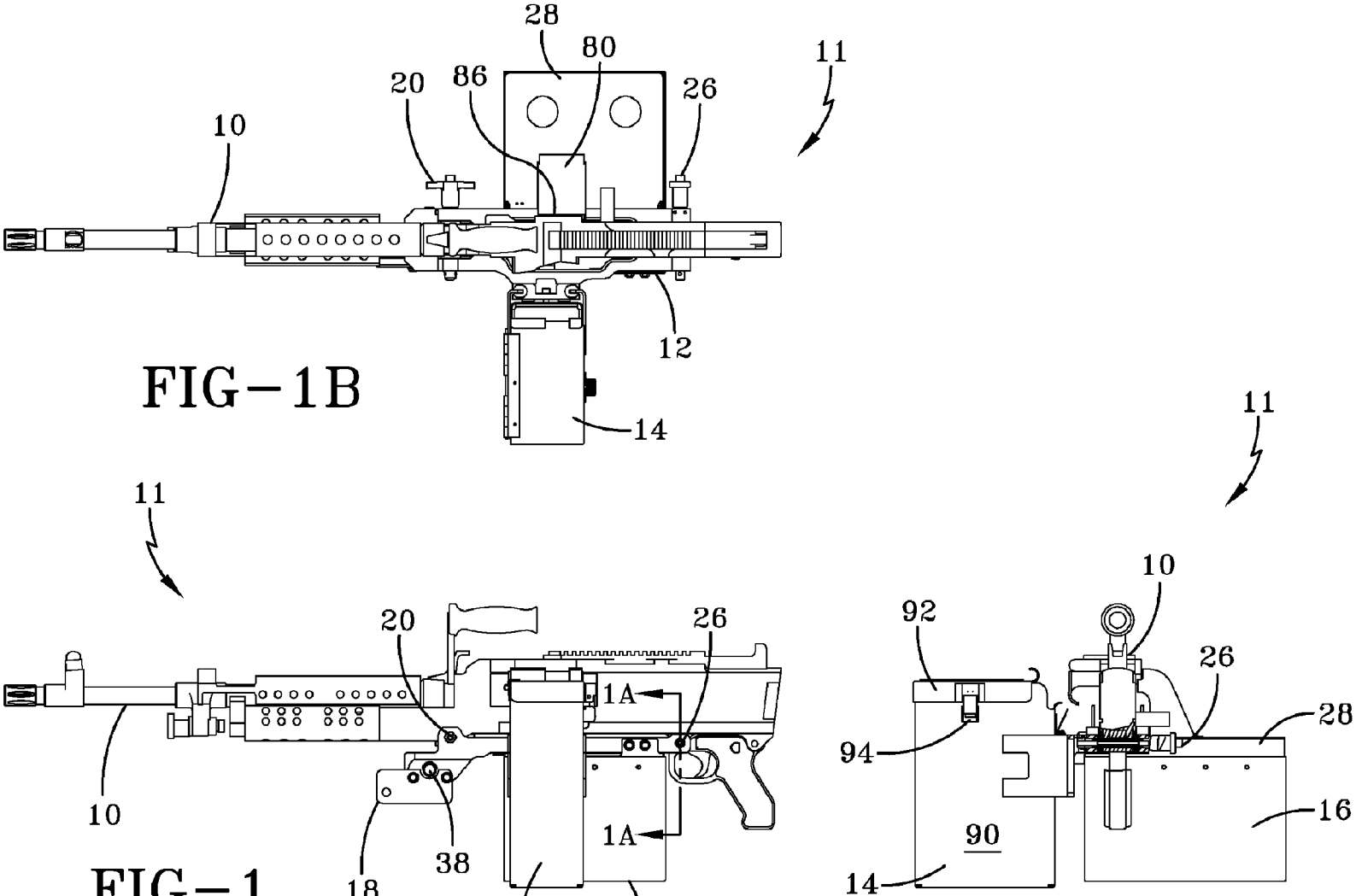
FIG. 1 is a side view of one embodiment of a machine gun mount in accordance with the invention.
FIG. 1A is a view along the line 1A-1A of FIG. 1.
FIG. 1B is a top view of FIG. 1.
Figure 11A:
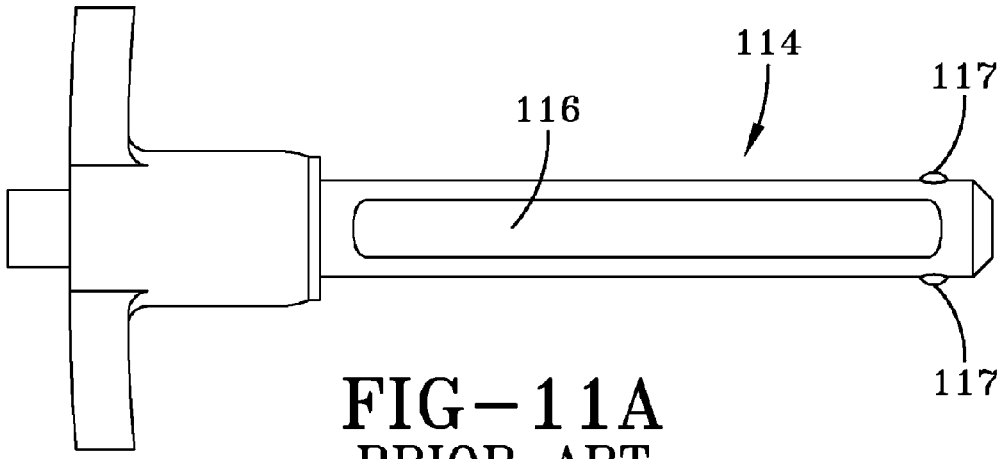
FIG-11A PRIOR ART
FIG. 11A shows a quick release pin and FIG. 11B shows a locking recess for the pin.

FIG. 1 is a side view of one embodiment of a machine gun mount 11 in accordance with the invention. FIG. 1A is a view along the line 1A-1A of FIG. 1. FIG. 1B is a top view of FIG. 1. A machine gun 10 is shown mounted in mount 11. The machine gun mount 11 includes a gun cradle 12, an ammunition magazine 14 disposed on a first side of the gun cradle 12 and a spent case catch bag 16 disposed on a second side of the gun cradle 12, opposite the ammunition magazine 14. The machine gun is attached to cradle 12 with a forward fastener 20 and an aft fastener 26. Fasteners 20, 26 are preferably quick release pins (FIG. 11A).

Figure 5:
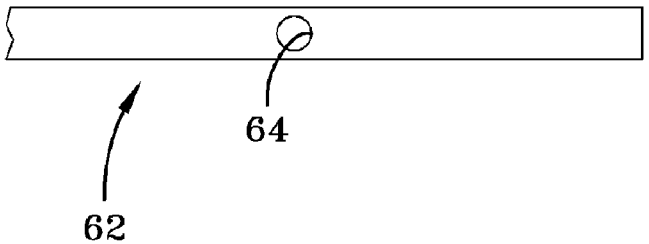
FIG. 5 shows a portion of a movable support arm.
Figure 2:
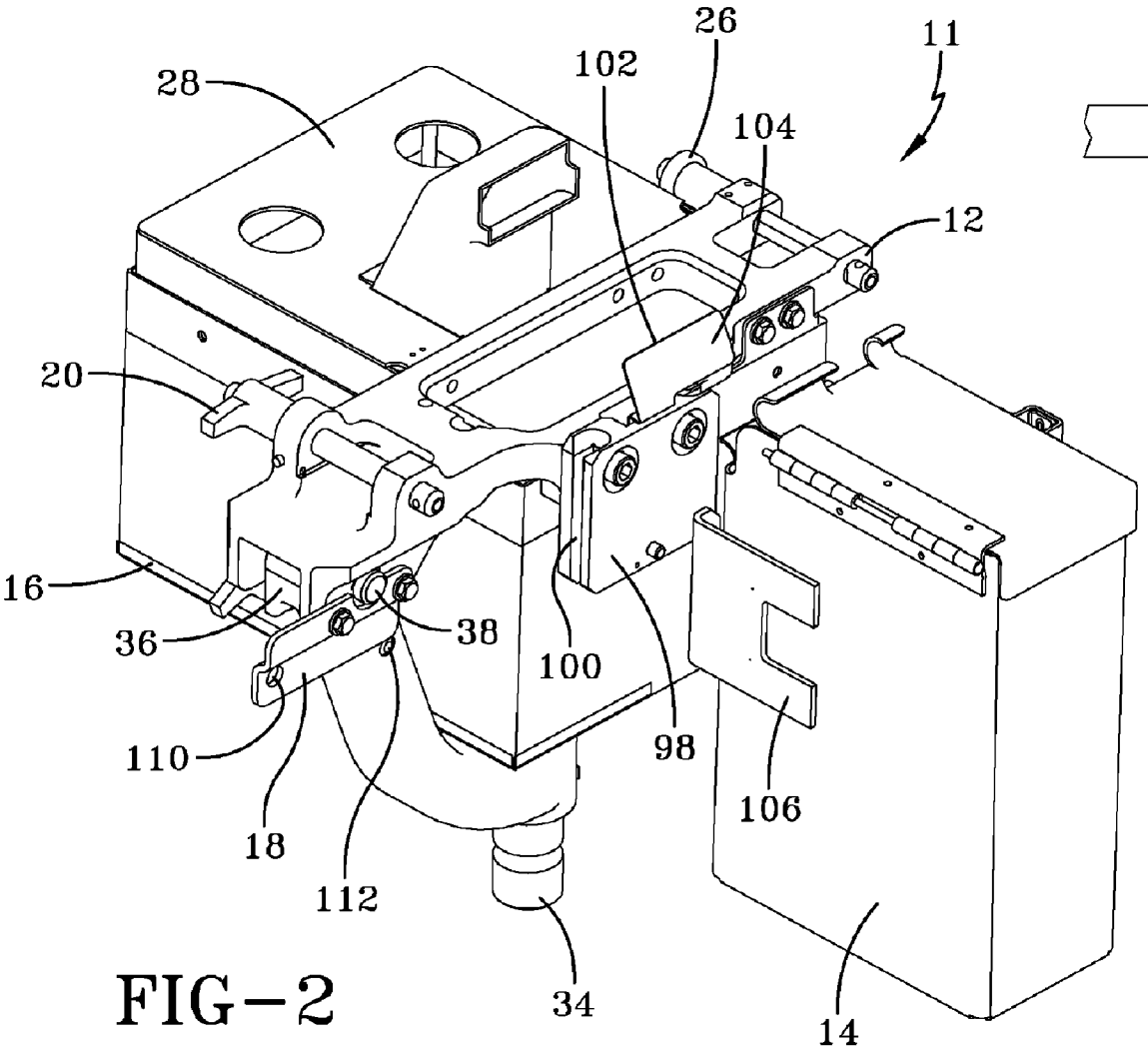
FIG. 2 is a perspective view of the mount of FIG. 1, including a pintle.

FIG. 2 is a perspective view of the mount 11 of FIG. 1, including a pintle 32 and without the machine gun 10. The pintle 32 is rotatably connected at a first end 34 to a movable support arm 62 (FIG. 5) that is connected to a helicopter. Support arm 62 includes a socket 64 for connecting to the first end 34 of pintle 32. The first end 34 of the pintle 32 provides for rotation of the machine gun 10 about a vertical axis. That is, end 34 of pintle 32 fits in a socket in the movable arm such that the end 34 may rotate in the socket.

Figure 3A:
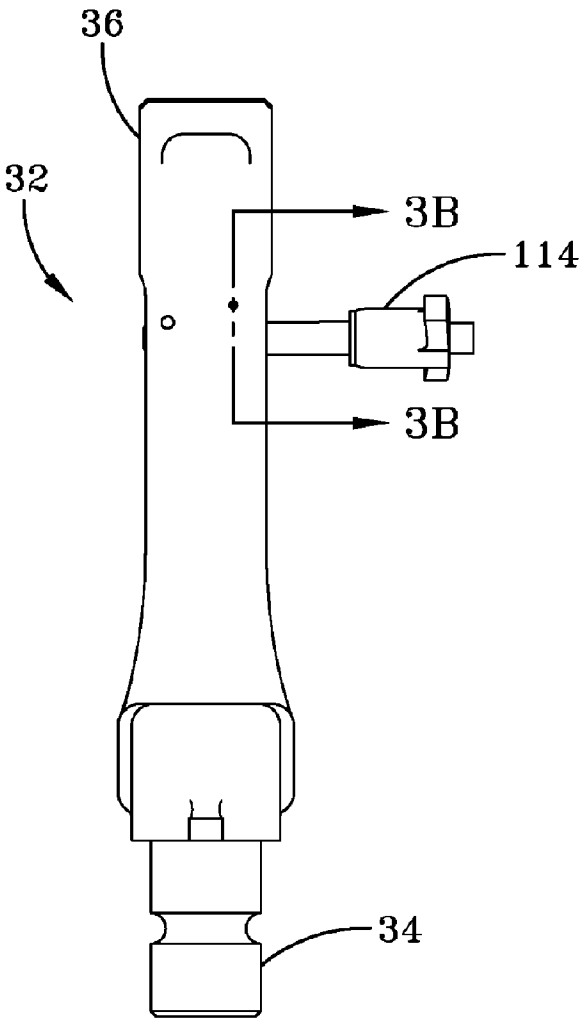
FIG. 3A is an end view of a pintle.
Figure 3B:
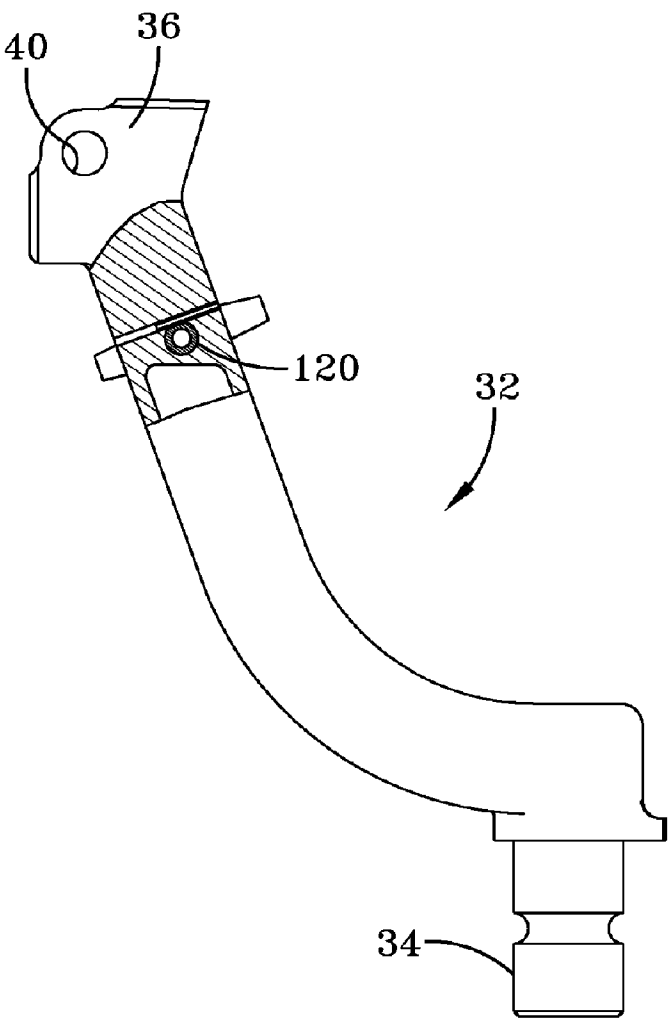
FIG. 3B is a view of a pintle along the line 3B-3B of FIG. 3A.

FIG. 3A is an end view of pintle 32 and FIG. 3B is a view of pintle 32 along the line 3B-3B of FIG. 3A. Gun cradle 12 is rotatably connected to a second end 36 of the pintle 32 with pin 38 (FIGS. 1 and 2) that fits in opening 40. The second end 36 of the pintle 32 provides for rotation of the machine gun 10 about a horizontal axis. That is, the cradle 12 can rotate about pin 38.

Figure 4A:
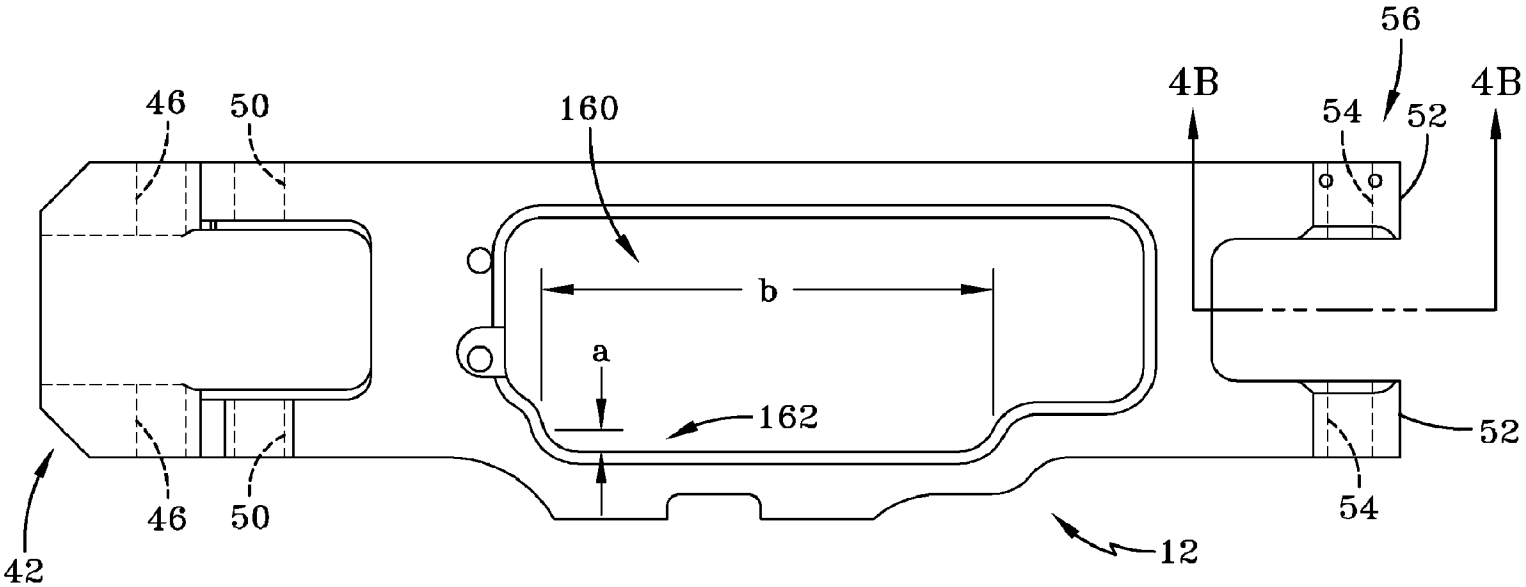
FIG. 4A is a top view of the cradle.
Figure 4B:
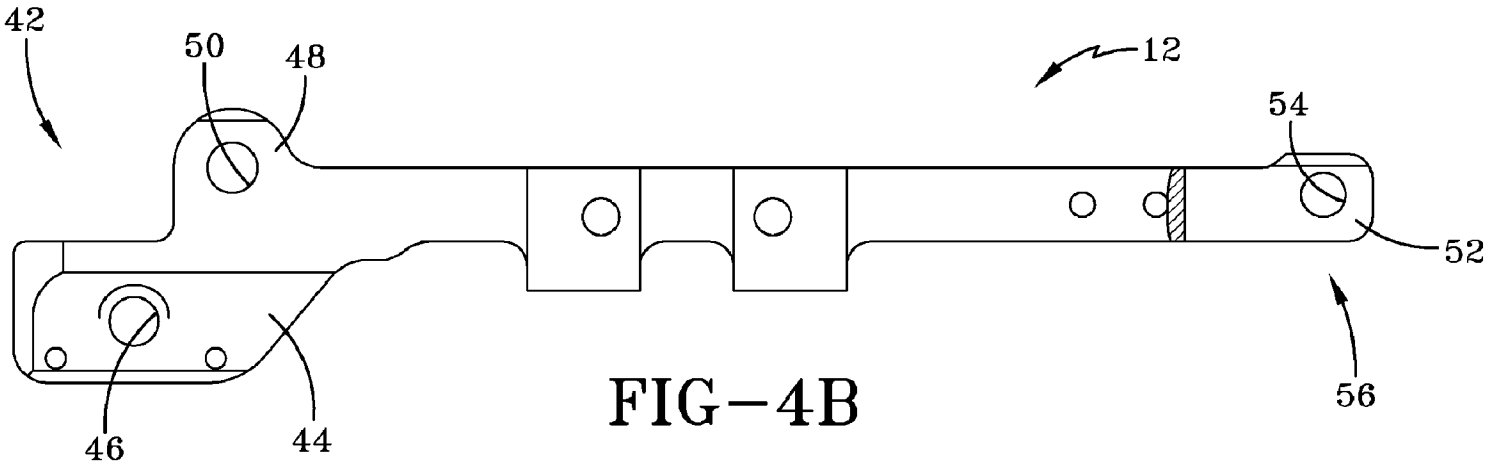
FIG. 4B is a side view of the cradle along the line 4B-4B of FIG. 4A.

FIG. 4A is a top view of the cradle 12. FIG. 4B is a side view of the cradle 12 along the line 4B-4B of FIG. 4A. The forward end 42 of the gun cradle 12 comprises a lower pair of transversely spaced lugs 44 with openings 46 therethrough. The second end 36 of the pintle 32 is disposed between the pair of transversely spaced lugs 44 and includes an opening 40 therethrough. The fastener 38 is disposed in the openings 46, 40 of the pair of transversely spaced lugs 44 and the second end 36 of the pintle 32. The fastener 38 rotatably connects the second end 36 of the pintle 32 with the forward end 42 of the gun cradle 12 (FIG. 2).

The forward end 42 of the gun cradle 12 also comprises an upper pair of transversely spaced lugs 48 with openings 50 therethrough. The aft end 56 of the gun cradle 12 comprises a pair of transversely spaced lugs 52 with openings 54 therethrough. The openings 50 in the upper pair of transversely spaced lugs 48 at the forward end of the gun cradle and the openings 54 in the pair of transversely spaced lugs 52 at the aft end of the gun cradle mate with respective forward and aft openings in the machine gun 10. Fasteners 20, 26 connect the forward and aft transversely spaced lugs 48, 52 with the forward and aft openings 58, 60 in the machine gun 10, respectively (FIG. 1).

Figure 6B:
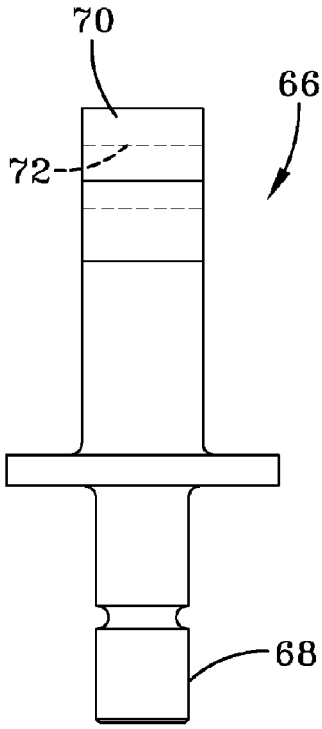
FIGS. 6A-D show an alternative pintle.
Figure 6A:
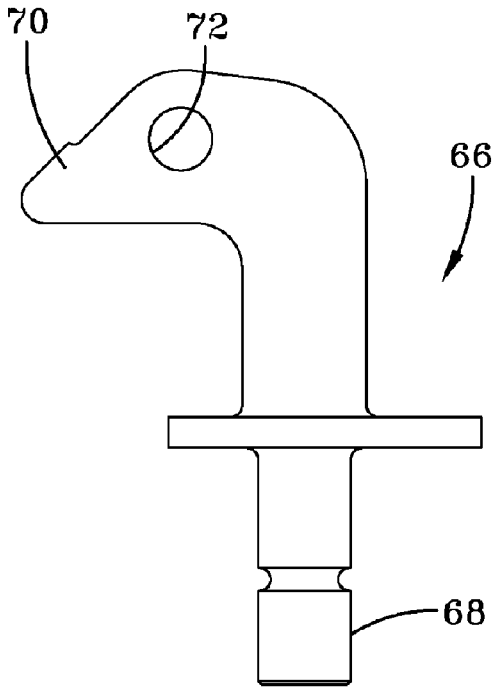
Figure 6D:
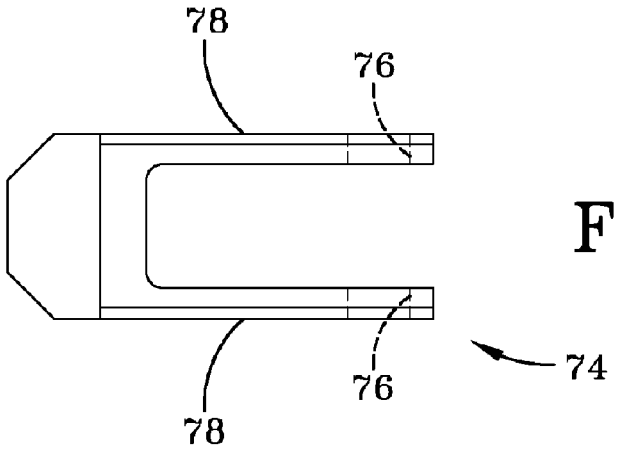
Figure 6C:
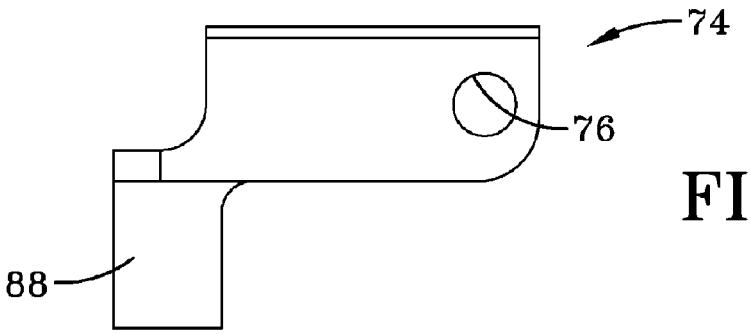

The pintle 32 shown in FIGS. 3A and 3B is suitable for use with the UH-60 helicopter. FIGS. 6A-6D show an alternative pintle 66 for use with the CH-47 helicopter. FIG. 6A is a side view and FIG. 6B is an end view of pintle 66. FIG. 6C is a side view and FIG. 6D is a top view of cam follower 74. Pintle 66 includes a first end 68 that is rotatably connected to the support arm 62 (FIG. 5) to allow rotation of the gun 10 about a vertical axis. The support arm 62 of FIG. 5 may differ in construction depending on the particular helicopter and mounting location. The second end 70 includes an opening 72. The second end 70 is disposed between the lower lugs 44 of the cradle 12. Pintle 66 includes a cam follower 74 having arms 78 with openings 76 formed therein. The arms 78 fit between the second end 70 of the pintle 66 and the lugs 44 of the cradle such that the openings 76 of the cam follower, 74 of the pintle and 46 of the lugs are aligned to receive pin 38. Extension 88 of the cam follower cooperates with support arm 62 (connection not shown in Figs.). As discussed before, cradle 12 is rotatable about the horizontal axis of pin 38.

Figure 7B:
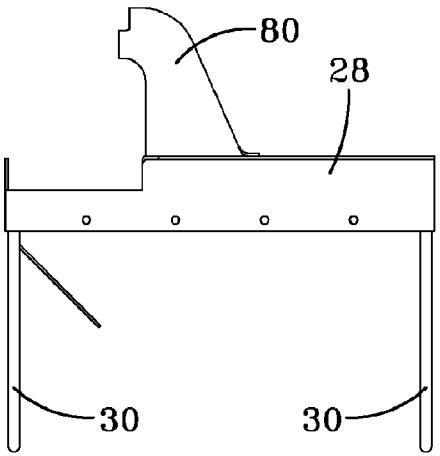
FIGS. 7A-C are top, side and end views of a spent case catch bag frame.
Figure 7A:
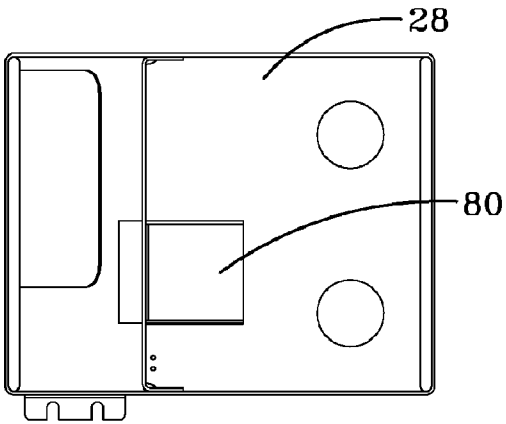
Figure 7C:
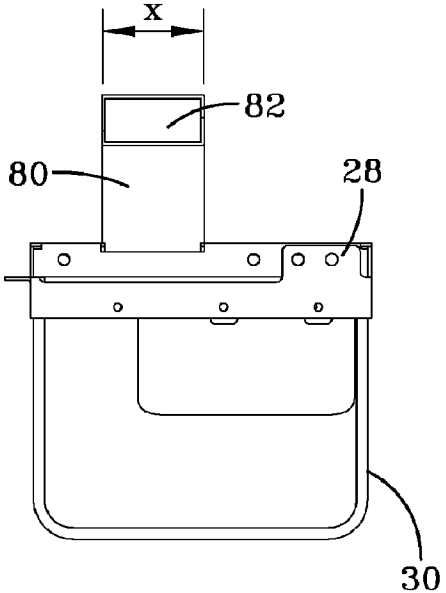

FIGS. 7A-C are top, side and end views of a spent case catch bag frame 28 that is attached to the gun cradle 12 (FIGS. 1A-C and 2) on a side opposite the magazine 14. The spent case catch bag 16 is attached to the spent case catch bag frame 28. The spent case catch bag frame 28 includes a pair of generally U-shaped supports 30 disposed at opposite ends of the frame 28. The supports 30 are disposed inside the catch bag 16 to support it. Without such supports 30, the cloth catch bag 16 will quickly deteriorate in the very windy helicopter environment. Supports 30 are made of, for example, aluminum.

On a top surface of the spent case catch bag frame 28 is a link chute 80 having an opening 82 therein. The link chute opening 82 mates with the link ejection opening 86 (FIG. 1B) in the machine gun 10. Used links from gun 10 are guided through the link chute 80 into the catch bag 16. The width x (FIG. 7C) of the link chute opening 82 is greater than the width of the link ejection opening 86 in the gun 10.

Figure 8:
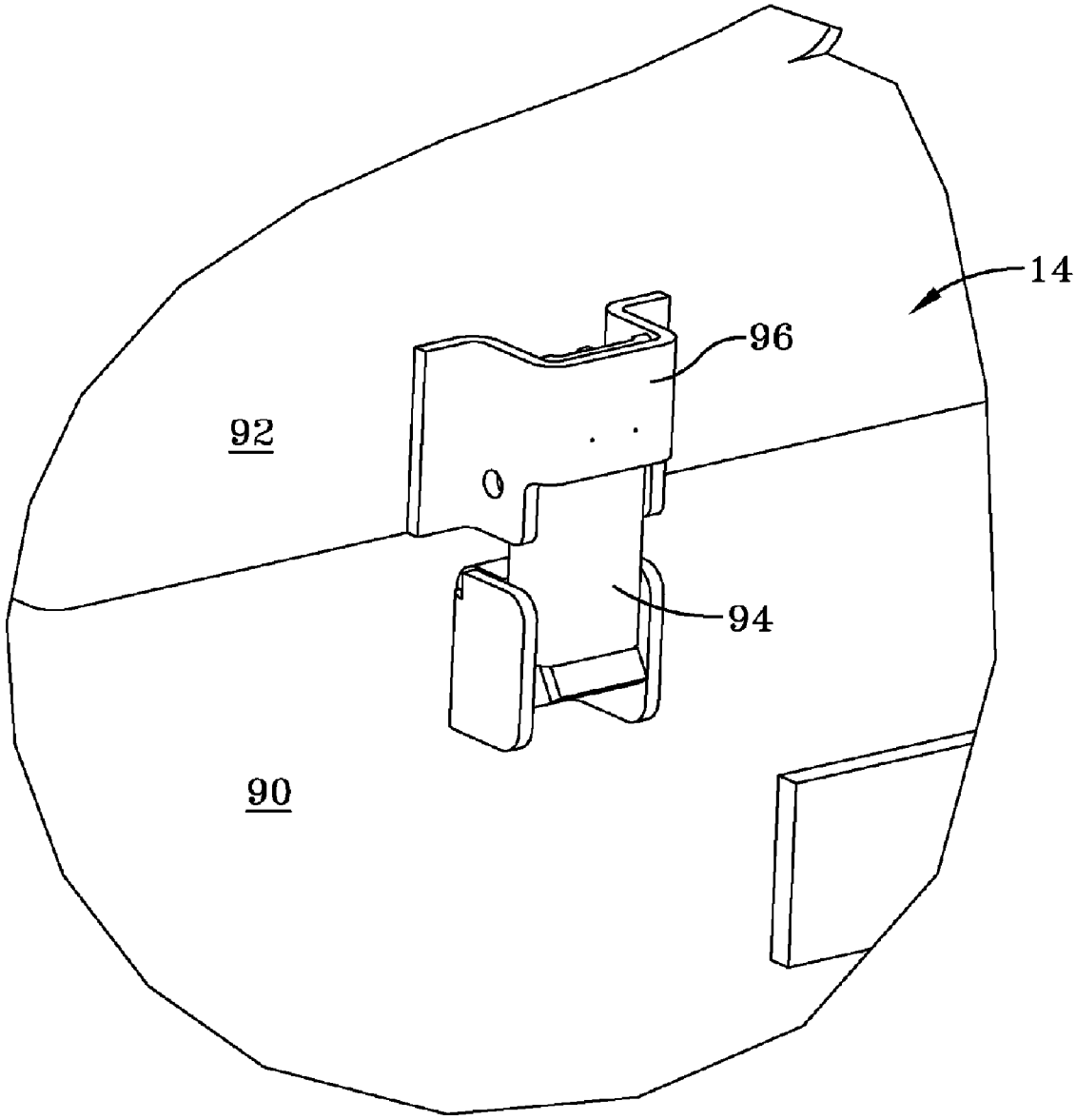
FIG. 8 is an enlarged view of a latch for closing the ammunition magazine lid.

The ammunition magazine 14 (FIG. 1A) comprises an ammunition box 90 and a lid 92 for closing the box 90. A latch 94 secures the lid 92 to the box 90. FIG. 8 is an enlarged view of a latch 94 for closing the ammunition magazine lid 92. A latch cover 96 covers the upper portion of latch 94 to prevent an accidental push from opening lid 92. With cover 96 in place, one must pull on the bottom of latch 94 to open it. Thus, the chance of an accidental opening by brushing against the latch 94 is eliminated.

Figure 9A:
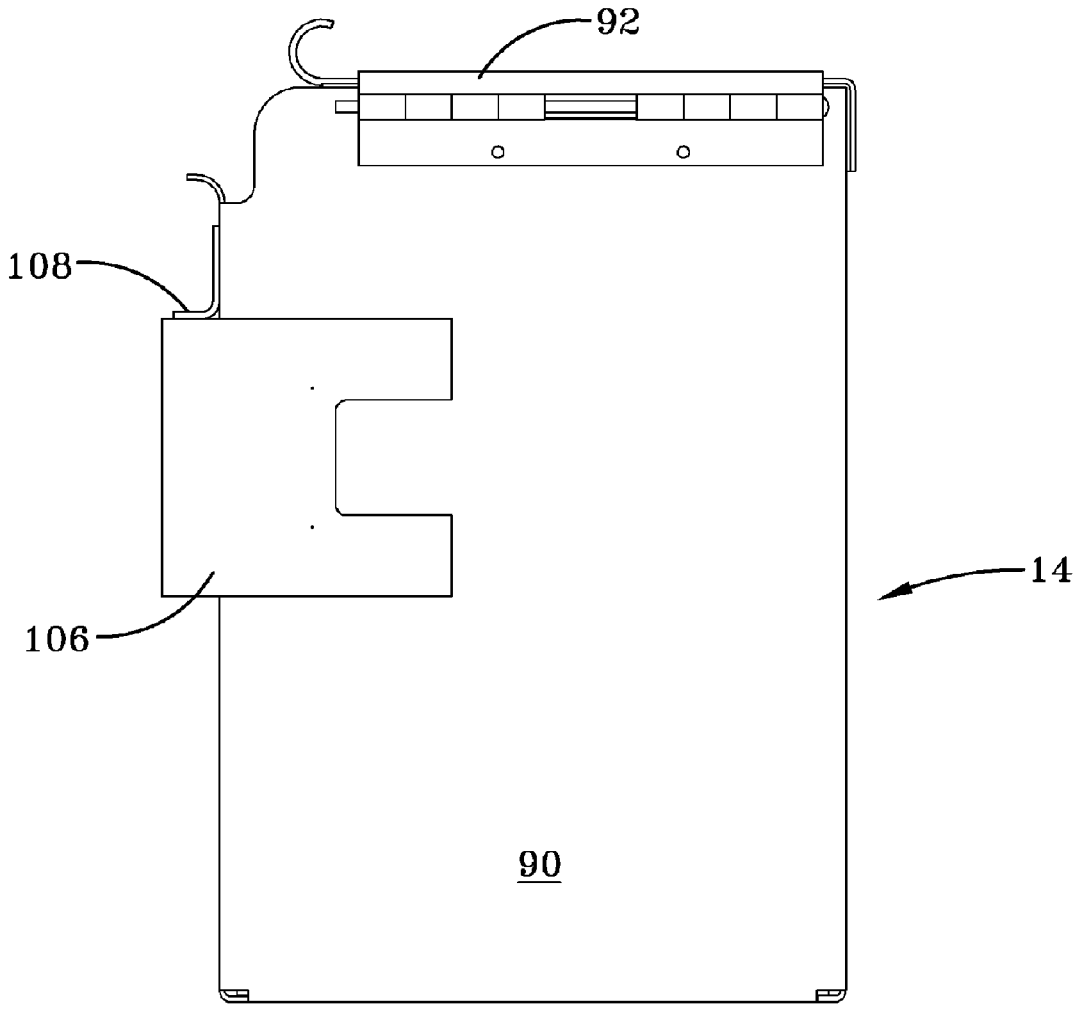
FIG. 9A is a side view and FIG. 9B is a bottom view of an ammunition magazine.
Figure 9B:
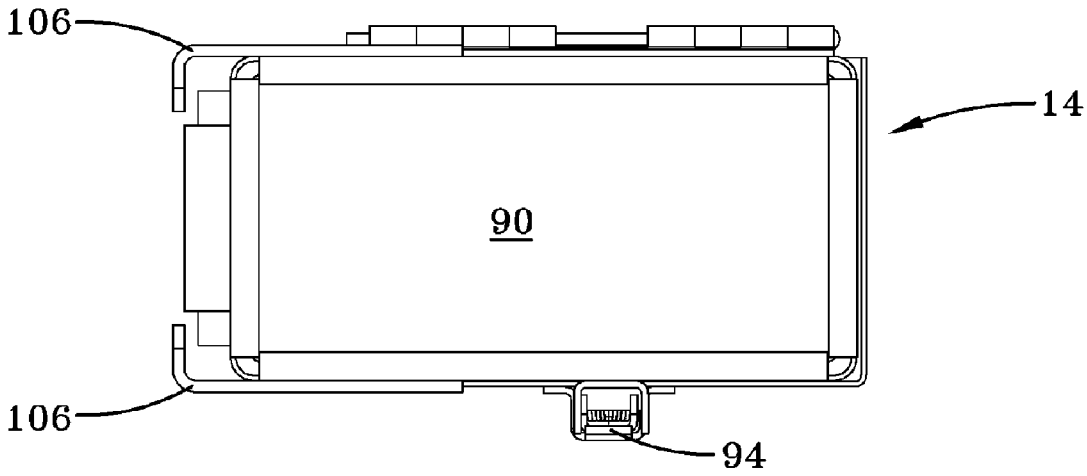
Figure 10A:
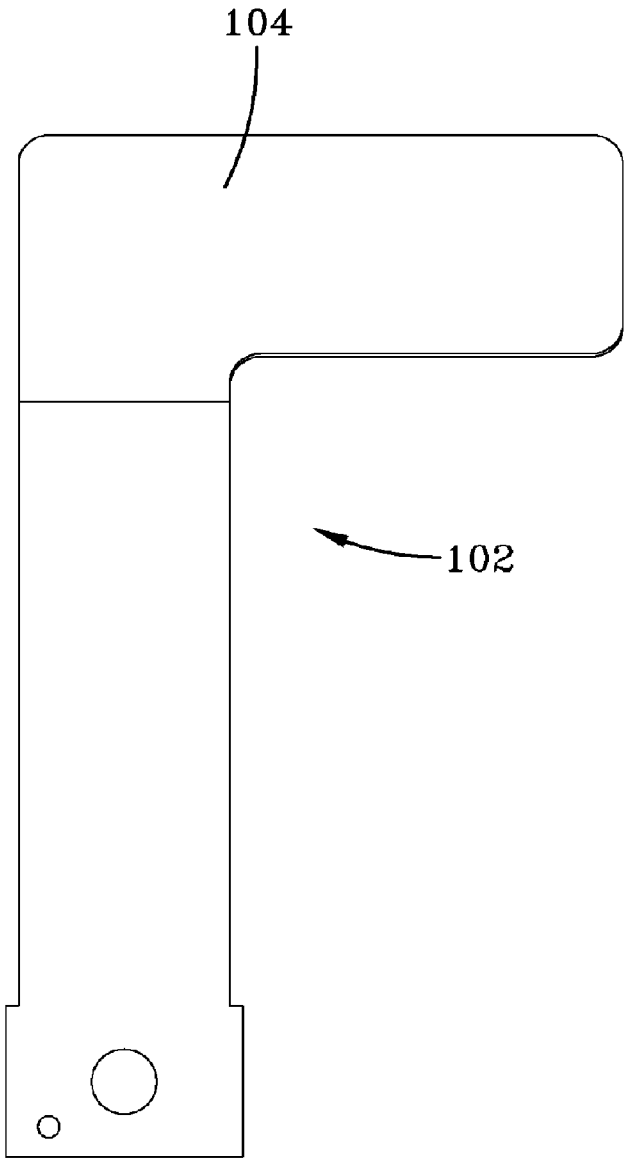
FIG. 10A is a side view and FIG. 10B is an end view of a latch for attaching the magazine to the cradle.
Figure 10B:
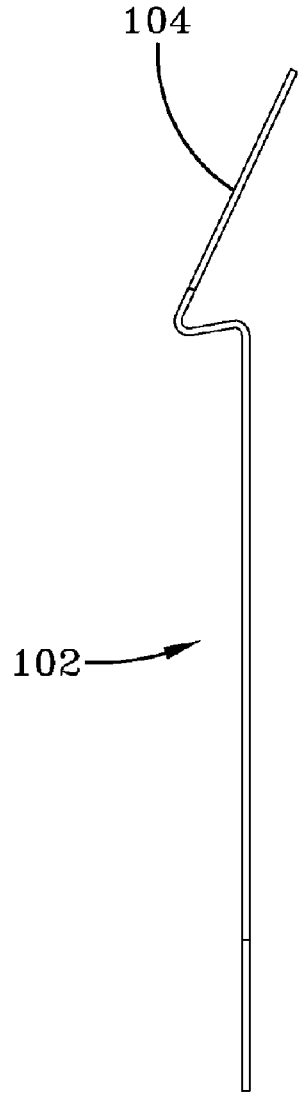

FIG. 9A is a side view and FIG. 9B is a bottom view of the ammunition magazine 14. FIG. 10A is a side view and FIG. 10B is an end view of a latch 102 for latching the magazine 14 to the cradle 12. A cradle bracket 98 (FIG. 2) is attached to the gun cradle 12. The cradle bracket 98 includes a pair of vertical slots 100 on opposite sides thereof. A spring latch 102 having a spring tab 104 is disposed in an opening in the cradle bracket 98. A pair of mounting brackets 106 are attached to the ammunition magazine 14 and are operable to slide in the vertical slots 100 in the cradle bracket 98. A stop 108 (FIG. 9A) is disposed on the ammunition magazine 14 above the pair of mounting brackets 106. To remove the magazine 14, the gun operator pulls the spring tab 104 clear of the stop 108 and lifts the magazine out of bracket 98. A new magazine can then be lowered into bracket 98. The position and structure of latch 102 allows the operator to unlatch the magazine 14 with one hand.

When using pintle 32, a travel lock 18 (FIG. 2) may be used to maintain the mount 11 in a vertical stowed position. In FIG. 2, the mount 11 is in the operating position (the gun 10 is not shown). When the gun and mount are stowed, the pin 38 is retracted a bit so that the pin 38 does not interfere with rotation of the travel lock 18. Then, the entire mount 11, including gun 10, cradle 12, magazine 14 and catch bag frame 28 is rotated about pin 38 into a substantially vertical position. At that position, the opening 110 in travel lock 18 is aligned with the opening 112 in pintle 32 and a fastener is inserted in the openings to maintain the travel lock in position.

Figure 11B:
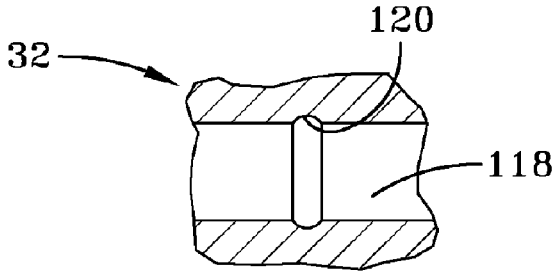
FIG-11B PRIOR ART

FIG. 11A shows a quick release pin 114 and FIG. 11B shows a locking recess 120 for the pin 114. Pin 114 is a known device that includes a flat 116 and at least one spring loaded ball 117 which locks the pin 114 in place when the pin is inserted completely through an opening. When pin 114 is retracted into opening 118 of pintle 32 to rotate travel lock 18, the recess 120 in opening 118 (FIG. 11B) in the pintle 32 captures the spring loaded ball or balls 117 and prevents the pin from being completely removed and lost. The recess 120 is a novel feature of the invention. Pin 114 may be used to secure the travel lock 18 in the stowed position as described above. Pin 114 may also be used to mount the gun 10 to gun cradle 12 (FIGS. 4A and B), in which case one of the upper pair of transversely spaced lugs 48 at the forward end 42 of the gun cradle 12 and one of the pair of transversely spaced lugs 52 at the aft end 56 of the gun cradle 12 will include recesses 120 for the at least one spring loaded ball 117.

Figure 12:
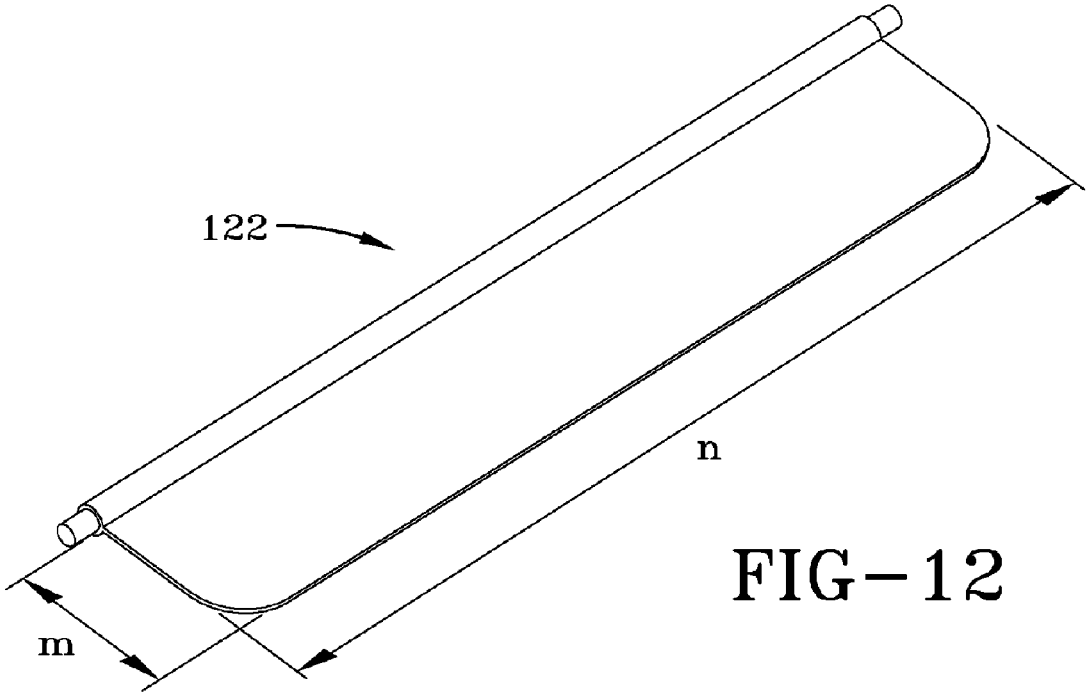
FIG. 12 is a perspective view of a gun dust cover.

FIG. 12 is a perspective view of a gun dust cover 122 having a length m and a width n. The dust cover 122 covers the spent cartridge ejection opening on the bottom of gun 10 and is generally rotatably mounted to the gun 10. The gun cradle 12 (FIG. 4A) includes a first generally rectangular opening 160 and adjacent thereto a second generally rectangular opening 162. So that the dust cover 122 may be opened after the gun 10 is mounted in gun cradle 12, the width a of the second generally rectangular opening 162 is at least as great as the width n of the dust cover 122 and the length b of the second.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A machine gun mount for attachment to a movable support arm of a helicopter and for holding a machine gun, the machine gun mount comprising:

a pintle that is rotatable connected at a first end to the movable support arm, the first end of the pintle providing for rotation of the machine gun about a vertical axis;

a gun cradle that is rotatably connected to a second end of the pintle, the second end of the pintle providing for rotation of the machine gun about a horizontal axis;

an ammunition magazine disposed on a first side of the gun cradle; and a spent case catch bag disposed on a second side of the gun cradle, further comprising a spent case catch bag frame attached to the second side of the gun cradle, the spent case catch bag being attached to the spent case catch bag frame, the spent case catch bag frame including a pair of generally U-shaped supports disposed inside the spent case catch bag at opposite ends thereof, wherein the spent case catch bag frame comprises a link chute on a top surface thereof, the link chute including an opening having a width that is greater than a width of a link ejection opening in the machine gun, wherein the ammunition magazine comprises a box, a lid and a latch for closing the lid to the box, an upper portion of the latch including a latch cover.

2. A machine gun mount for attachment to a movable support arm of a helicopter and for holding a machine gun, the machine gun mount comprising:

a pintle that is rotatable connected at a first end to the movable support arm, the first end of the pintle providing for rotation of the machine gun about a vertical axis;

a gun cradle that is rotatable connected to a second end of the pintle, the second end of the pintle providing for rotation of the machine gun about a horizontal axis;

an ammunition magazine disposed on a first side of the gun cradle; and a spent case catch bag disposed on a second side of the gun cradle, further comprising a cradle bracket attached to the first side of the gun cradle, the cradle bracket including a pair of vertical slots on opposite sides thereof and a spring latch disposed in an opening in the cradle bracket; a pair of mounting brackets attached to the ammunition magazine and operable to slide in the vertical slots in the cradle bracket; and a stop disposed on the ammunition magazine above the pair of mounting brackets.

3. A machine gun mount for attachment to a movable support arm of a helicopter and for holding a machine gun, the machine gun mount comprising:

a pintle that is rotatable connected at a first end to the movable support arm, the first end of the pintle providing for rotation of the machine gun about a vertical axis;

a gun cradle that is rotatably connected to a second end of the pintle, the second end of the pintle providing for rotation of the machine gun about a horizontal axis;

an ammunition magazine disposed on a first side of the gun cradle; and a spent case catch bag disposed on a second side of the gun cradle, wherein a forward end of the gun cradle comprises a lower pair of transversely spaced lugs with openings therethrough, the second end of the pintle being disposed between the pair of transversely spaced lugs and including an opening therethrough, the machine gun mount further comprising a fastener disposed in the openings of the pair of transversely spaced lugs and the second end of the pintle, the fastener rotatably connecting the second end of the pintle with the forward end of the gun cradle.

4. A machine gun mount for attachment to a movable support arm of a helicopter and for holding a machine gun, the machine gun mount comprising:

a pintle that is rotatably connected at a first end to the movable support arm, the first end of the pintle providing for rotation of the machine gun about a vertical axis;

a gun cradle that is rotatably connected to a second end of the pintle, the second end of the pintle providing for rotation of the machine gun about a horizontal axis;

an ammunition magazine disposed on a first side of the gun cradle; and a spent case catch bag disposed on a second side of the gun cradle, wherein a forward end of the gun cradle comprises a lower pair of transversely spaced lugs with openings therethrough, the second end of the pintle being disposed between the pair of transversely spaced lugs and including an opening therethrough, the machine gun mount further comprising a fastener disposed in the openings of the pair of transversely spaced lugs and the second end of the pintle, the fastener rotatably connecting the second end of the pintle with the forward end of the gun cradle, wherein a forward end of the gun cradle comprises an upper pair of transversely spaced lugs with openings therethrough and an aft end of the gun cradle comprises a pair of transversely spaced lugs with openings therethrough, the openings in the upper pair of transversely spaced lugs at the forward end of the gun cradle and the openings in the pair of transversely spaced lugs at the aft end of the gun cradle mating with respective forward and aft openings in the machine gun, the machine gun mount further comprising a pair of fasteners for connecting the forward and aft transversely spaced lugs with the forward and aft openings in the machine gun, respectively.

5. A machine gun mount for attachment to a movable support arm of a helicopter and for holding a machine gun, the machine gun mount comprising:

a pintle that is rotatably connected at a first end to the movable support arm, the first end of the pintle providing for rotation of the machine gun about a vertical axis;

a gun cradle that is rotatably connected to a second end of the pintle, the second end of the pintle providing for rotation of the machine gun about a horizontal axis;

an ammunition magazine disposed on a first side of the gun cradle; and a spent case catch bag disposed on a second side of the gun cradle, wherein a forward end of the gun cradle comprises a lower pair of transversely spaced lugs with openings therethrough, the second end of the pintle being disposed between the pair of transversely spaced lugs and including an opening therethrough, the machine gun mount further comprising a fastener disposed in the openings of the pair of transversely spaced lugs and the second end of the pintle, the fastener rotatably connecting the second end of the pintle with the forward end of the gun cradle, wherein a forward end of the gun cradle comprises an upper pair of transversely spaced lugs with openings therethrough and an aft end of the gun cradle comprises a pair of transversely spaced lugs with openings therethrough, the openings in the upper pair of transversely spaced lugs at the forward end of the gun cradle and the openings in the pair of transversely spaced lugs at the aft end of the gun cradle mating with respective forward and aft openings in the machine gun, the machine gun mount further comprising a pair of fasteners for connecting the forward and aft transversely spaced lugs with the forward and aft openings in the machine gun, respectively, and wherein the pair of fasteners comprise quick release pins having at least one spring loaded ball at an end thereof and wherein one of the upper pair of transversely spaced lugs at the forward end of the gun cradle and one of the pair of transversely spaced lugs at the aft end of the gun cradle include recesses for the at least one spring loaded ball.

6. A machine gun mount for attachment to a movable support arm of a helicopter and for holding a machine gun, the machine gun mount comprising:

a pintle that is rotatably connected at a first end to the movable support arm, the first end of the pintle providing for rotation of the machine gun about a vertical axis;

a gun cradle that is rotatable connected to a second end of the pintle, the second end of the pintle providing for rotation of the machine gun about a horizontal axis;

an ammunition magazine disposed on a first side of the gun cradle; and a spent case catch bag disposed on a second side of the gun cradle, further including a travel lock attached to the pintle and a quick release pin having at least one spring loaded ball at an end thereof; the pintle including an opening therethrough that includes a recess for the at least one spring loaded ball, wherein the gun cradle includes a first generally rectangular opening and adjacent thereto a second generally rectangular opening, a width of the second generally rectangular opening being at least as great as a width of a dust cover of the gun and a length of the second generally rectangular opening being greater than a length of the dust cover.

7. An apparatus, comprising:

a machine gun having a link ejection opening, a spent cartridge ejection opening and a dust cover for covering the spent cartridge ejection opening; and a machine gun mount for attachment to a movable support arm of a helicopter and for holding the machine gun, the machine gun mount comprising a pintle that is rotatable connected at a first end to the movable support arm, the first end of the pintle providing for rotation of the machine gun about a vertical axis; a gun cradle that is rotatable connected to a second end of the pintle, the second end of the pintle providing for rotation of the machine gun about a horizontal axis; an ammunition magazine disposed on a first side of the gun cradle; and a spent case catch bag disposed on a second side of the gun cradle, wherein the machine gun mount further comprises a spent case catch bag frame attached to the second side of the gun cradle, the spent case catch bag being attached to the spent case catch bag frame, the spent case catch bag frame including a pair of generally U-shaped supports disposed inside the spent case catch bag at opposite ends thereof, wherein the spent case catch bag frame comprises a link chute on a top surface thereof, the link chute including an opening having a width that is greater than a width of the link ejection opening in the machine gun, wherein the ammunition magazine comprises a box, a lid and a latch for closing the lid to the box, an upper portion of the latch including a latch cover.

8. A machine gun mount for attachment to a movable support arm of a helicopter and for holding a machine gun, the machine gun mount comprising:

a pintle that is rotatable connected at a first end to the movable support arm, the first end of the pintle providing for rotation of the machine gun about a vertical axis;

a gun cradle that is rotatably connected to a second end of the pintle, the second end of the pintle providing for rotation of the machine gun about a horizontal axis;

an ammunition magazine disposed on a first side of the gun cradle; and a spent case catch bag disposed on a second side of the gun cradle, including a travel lock attached to the pintle and a quick release pin having at least one spring loaded ball at an end thereof; the pintle including an opening therethrough that includes a recess for the at least one spring loaded ball, and wherein the gun cradle includes a first generally rectangular opening and adjacent thereto a second generally rectangular opening, a width of the second generally rectangular opening being at least as great as a width of a dust cover of the gun and a length of the second generally rectangular opening being greater than a length of the dust cover, and wherein the machine gun mount further comprises a cradle bracket attached to the first side of the gun cradle, the cradle bracket including a pair of vertical slots on opposite sides thereof and a spring latch disposed in an opening in the cradle bracket; a pair of mounting brackets attached to the ammunition magazine and operable to slide in the vertical slots in the cradle bracket; and a stop disposed on the ammunition magazine above the pair of mounting brackets.

9. A machine gun mount for attachment to a movable support arm of a helicopter and for holding a machine gun, the machine gun mount comprising:

a pintle that is rotatable connected at a first end to the movable support arm, the first end of the pintle providing for rotation of the machine gun about a vertical axis;

a gun cradle that is rotatably connected to a second end of the pintle, the second end of the pintle providing for rotation of the machine gun about a horizontal axis;

an ammunition magazine disposed on a first side of the gun cradle; and a spent case catch bag disposed on a second side of the gun cradle, including a travel lock attached to the pintle and a quick release pin having at least one spring loaded ball at an end thereof; the pintle including an opening therethrough that includes a recess for the at least one spring loaded ball, and wherein the gun cradle includes a first generally rectangular opening and adjacent thereto a second generally rectangular opening, a width of the second generally rectangular opening being at least as great as a width of a dust cover of the gun and a length of the second generally rectangular opening being greater than a length of the dust cover, and wherein a forward end of the gun cradle comprises a lower pair of transversely spaced lugs with openings therethrough, the second end of the pintle being disposed between the pair of transversely spaced lugs and including an opening therethrough, the machine gun mount further comprising a fastener disposed in the openings of the pair of transversely spaced lugs and the second end of the pintle, the fastener rotatably connecting the second end of the pintle with the forward end of the gun cradle.

10. A machine gun mount for attachment to a movable support arm of a helicopter and for holding a machine gun, the machine gun mount comprising:

a pintle that is rotatable connected at a first end to the movable support arm, the first end of the pintle providing for rotation of the machine gun about a vertical axis;

a gun cradle that is rotatable connected to a second end of the pintle, the second end of the pintle providing for rotation of the machine gun about a horizontal axis;

an ammunition magazine disposed on a first side of the gun cradle; and a spent case catch bag disposed on a second side of the gun cradle, including a travel lock attached to the pintle and a quick release pin having at least one spring loaded ball at an end thereof; the pintle including an opening therethrough that includes a recess for the at least one spring loaded ball, and wherein the gun cradle includes a first generally rectangular opening and adjacent thereto a second generally rectangular opening, a width of the second generally rectangular opening being at least as great as a width of a dust cover of the gun and a length of the second generally rectangular opening being greater than a length of the dust cover, and wherein a forward end of the gun cradle comprises a lower pair of transversely spaced lugs with openings therethrough, the second end of the pintle being disposed between the pair of transversely spaced lugs and including an opening therethrough, the machine gun mount further comprising a fastener disposed in the openings of the pair of transversely spaced lugs and the second end of the pintle, the fastener rotatably connecting the second end of the pintle with the forward end of the gun cradle, wherein a forward end of the gun cradle comprises an upper pair of transversely spaced lugs with openings therethrough and an aft end of the gun cradle comprises a pair of transversely spaced lugs with openings therethrough, the openings in the upper pair of transversely spaced lugs at the forward end of the gun cradle and the openings in the pair of transversely spaced lugs at the aft end of the gun cradle mating with respective forward and aft openings in the machine gun, the machine gun mount further comprising a pair of fasteners for connecting the forward and aft transversely spaced lugs with the forward and aft openings in the machine gun, respectively.

11. A machine gun mount for attachment to a movable support arm of a helicopter and for holding a machine gun, the machine gun mount comprising:

a pintle that is rotatably connected at a first end to the movable support arm, the first end of the pintle providing for rotation of the machine gun about a vertical axis;

a gun cradle that is rotatably connected to a second end of the pintle, the second end of the pintle providing for rotation of the machine gun about a horizontal axis;

an ammunition magazine disposed on a first side of the gun cradle; and a spent case catch bag disposed on a second side of the gun cradle, including a travel lock attached to the pintle and a quick release pin having at least one spring loaded ball at an end thereof; the pintle including an opening therethrough that includes a recess for the at least one spring loaded ball, and wherein the gun cradle includes a first generally rectangular opening and adjacent thereto a second generally rectangular opening, a width of the second generally rectangular opening being at least as great as a width of a dust cover of the gun and a length of the second generally rectangular opening being greater than a length of the dust cover, and wherein a forward end of the gun cradle comprises a lower pair of transversely spaced lugs with openings therethrough, the second end of the pintle being disposed between the pair of transversely spaced lugs and including an opening therethrough, the machine gun mount further comprising a fastener disposed in the openings of the pair of transversely spaced lugs and the second end of the pintle, the fastener rotatable connecting the second end of the pintle with the forward end of the gun cradle, wherein a forward end of the gun cradle comprises an upper pair of transversely spaced lugs with openings therethrough and an aft end of the gun cradle comprises a pair of transversely spaced lugs with openings therethrough, the openings in the upper pair of transversely spaced lugs at the forward end of the gun cradle and the openings in the pair of transversely spaced lugs at the aft end of the gun cradle mating with respective forward and aft openings in the machine gun, the machine gun mount further comprising a pair of fasteners for connecting the forward and aft transversely spaced lugs with the forward and aft openings in the machine gun, respectively, wherein the pair of fasteners comprise quick release pins having at least one spring loaded ball at an end thereof and wherein one of the upper pair of transversely spaced lugs at the forward end of the gun cradle and one of the pair of transversely spaced lugs at the aft end of the gun cradle include recesses for the at least one spring loaded ball.

12. A machine gun mount for attachment to a movable support arm of a helicopter and for holding a machine gun, the machine gun mount comprising:

a pintle that is rotatably connected at a first end to the movable support arm, the first end of the pintle providing for rotation of the machine gun about a vertical axis;

a gun cradle that is rotatable connected to a second end of the pintle, the second end of the pintle providing for rotation of the machine gun about a horizontal axis;

an ammunition magazine disposed on a first side of the gun cradle; and a spent case catch bag disposed on a second side of the gun cradle, further including a travel lock attached to the pintle and a quick release pin having at least one spring loaded ball at an end thereof; the pintle including an opening therethrough that includes a recess for the at least one spring loaded ball, wherein the gun cradle includes a first generally rectangular opening and adjacent thereto a second generally rectangular opening, a width of the second generally rectangular opening being at least as great as a width of a dust cover of the gun and a length of the second generally rectangular opening being greater than a length of the dust cover, wherein the machine gun mount further comprises a travel lock attached to the pintle and a quick release pin having at least one spring loaded ball at an end thereof; the pintle including an opening therethrough that includes a recess for the at least one spring loaded ball.

13. A machine gun mount for attachment to a movable support arm of a helicopter and for holding a machine gun, the machine gun mount comprising:

a pintle that is rotatable connected at a first end to the movable support arm, the first end of the pintle providing for rotation of the machine gun about a vertical axis;

a gun cradle that is rotatable connected to a second end of the pintle, the second end of the pintle providing for rotation of the machine gun about a horizontal axis;

an ammunition magazine disposed on a first side of the gun cradle; and a spent case catch bag disposed on a second side of the gun cradle, further including a travel lock attached to the pintle and a quick release pin having at least one spring loaded ball at an end thereof; the pintle including an opening therethrough that includes a recess for the at least one spring loaded ball, wherein the gun cradle includes a first generally rectangular opening and adjacent thereto a second generally rectangular opening, a width of the second generally rectangular opening being at least as great as a width of a dust cover of the gun and a length of the second generally rectangular opening being greater than a length of the dust cover, wherein the machine gun mount further comprises a travel lock attached to the pintle and a quick release pin having at least one spring loaded ball at an end thereof; the pintle including an opening therethrough that includes a recess for the at least one spring loaded ball, wherein the gun cradle includes a first generally rectangular opening and adjacent thereto a second generally rectangular opening, a width of the second generally rectangular opening being at least as great as a width of a dust cover of the gun and a length of the second generally rectangular opening being greater than a length of the dust cover.

* * * * *